US006339882B1

(12) United States Patent
Goessling et al.

(10) Patent No.: US 6,339,882 B1
(45) Date of Patent: Jan. 22, 2002

(54) FLUSH VALVE

(75) Inventors: Kent Goessling, Fullerton; John McKay, Placentia, both of CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 0 days.

(21) Appl. No.: 09/626,692

(22) Filed: Jul. 27, 2000

(51) Int. Cl.[7] ..... B21D 51/16; E03D 1/35; B29B 7/00; B22C 9/24

(52) U.S. Cl. ..... 29/890.127; 29/890.124; 29/452; 4/392; 264/328.1; 249/145

(58) Field of Search ..... 4/331, 366, 382, 4/384, 387, 392, 394, 378, 404, 403; 29/890.12, 890.122, 890.124, 890.126, 890.127, 446, 452, 453; 264/238, 328.1; 249/145

(56) References Cited

U.S. PATENT DOCUMENTS 1,147,024 A * 7/1915 Jackson ..... 4/392
1,353,804 A * 9/1920 Schossow ..... 4/392
1,750,427 A * 3/1930 Paul ..... 4/392
1,928,130 A * 9/1933 Kauffman ..... 4/392
2,847,026 A * 8/1958 Nelson ..... 4/392
3,858,250 A * 1/1975 Coglitore ..... 4/392
5,961,910 A * 10/1999 Ito et al. ..... 264/238
6,261,488 B1 * 7/2001 Bradt ..... 264/328.1

OTHER PUBLICATIONS

A photocopy of a horizontal flush valve seat manufactured by American Standard under the model No. 1011.

* cited by examiner

*Primary Examiner*—S. Thomas Hughes
*Assistant Examiner*—Marc Jimenez
(74) *Attorney, Agent, or Firm*—Richard L. Myers; Myers, Dawes & Andras LLP

(57) ABSTRACT

A flush valve is adapted for placement through a hole in the bottom of a toilet tank. The valve seat has an axis with a lower section adapted to extend through the hole and an upper section defining an opening generally perpendicular to the axis. A first sleeve communicates with a central channel in the upper section. A valve elbow has a second axis with an overflow section and a second sleeve registerable with the first sleeve to provide fluid communication between the overflow section and the (central channel) an associated method includes injection molding steps wherein first and second core pins are removed laterally and the second sleeve is inserted into the first sleeve to provide fluid communication between the overflow section of the valve elbow in the central channel of the valve seat.

5 Claims, 4 Drawing Sheets

FLUSH VALVE

BACKGROUND OF THE INVENTION

1. Field of the Invention

This invention relates generally to toilet valves, and more specifically to flush valves adapted for use in the tank of the toilet.

2. Description of the Prior Art

A typical toilet construction includes a toilet bowl, and a toilet tank which is initially filled through a fill valve. A flush valve is mounted in the bottom of the tank and is operable to release the water in the toilet tank to flush the toilet bowl.

In the past, flush valves have been constructed in a one-piece configuration with a valve seat having a central channel extending along a first axis and a valve elbow having an overflow tube extending along a second axis. A lateral passage provided fluid communication between the overflow tube of the elbow and the central channel of the seat. A flapper valve has been pivotal on the elbow and operable with respect to an opening on the seat to open and close the valve.

Initially, the opening in the valve seat was defined in a plane perpendicular to the axis of the valve seat and parallel to the bottom of the tank. This configuration provided the best loading of the flapper valve in the closed state. The one-piece construction was formed as a brass casting.

As the cost of castings increased, the industry began to look to injection molding for its economies of scale. Improving on the one-piece construction, injection molding could only be achieved using a core pin to define the lateral passage between the valve seat and the valve elbow. Lateral removal of this core pin required that the opening into the valve seat be canted from the prior perpendicular relationship with the axis of the seat. By canting the opening, the core pin, which was necessary to define the lateral channel, could be both inserted and removed through the opening. This process greatly reduced the unit cost of the product, but this was achieved only with the disadvantages associated with a candid valve seat and a generally reduced magnitude of flow. This magnitude of flow was dependent upon the size of the lateral channel which was necessarily limited by the size of the cord pin which could be inserted and removed through the candid opening.

SUMMARY OF THE INVENTION

In accordance with the present invention, a flush valve is provided with the economies of scale resulting from injection molding, along with a perpendicular valve opening providing uniform valve loading, and an enlarged lateral channel facilitating a higher flush rate.

The flush valve is constructed in two portions, a valve seat having a first sleeve in a valve opening having a second sleeve registerable with the first sleeve to create the lateral (passage). During the injection molding of the valve seat, a cord pin defining the first sleeve is removable, not through the valve opening, but laterally of the valve seat. Similarly, a cord pin defining the second sleeve in the injection molding of the valve elbow can also be removed laterally. In a final step achieving a one-piece construction, the second sleeve is inserted into the first sleeve in a friction fit relationship to define the lateral passage. Since the size of this passage is not dependent upon the size of the valve opening, it can be made larger thereby increasing the flush volume. Also, since it is not necessary to insert or remove a cord pin through opening, the opening can be formed in its preferred perpendicular relationship with the axis of the seat to provide for substantial uniform valve loading.

These and other features and advantages of the invention will be better understood with a discussion of preferred embodiments and reference to the associated drawings.

A DESCRIPTION OF THE DRAWINGS

DESCRIPTION OF PREFERRED EMBODIMENTS AND BEST MODE OF THE INVENTION

Figure 1:
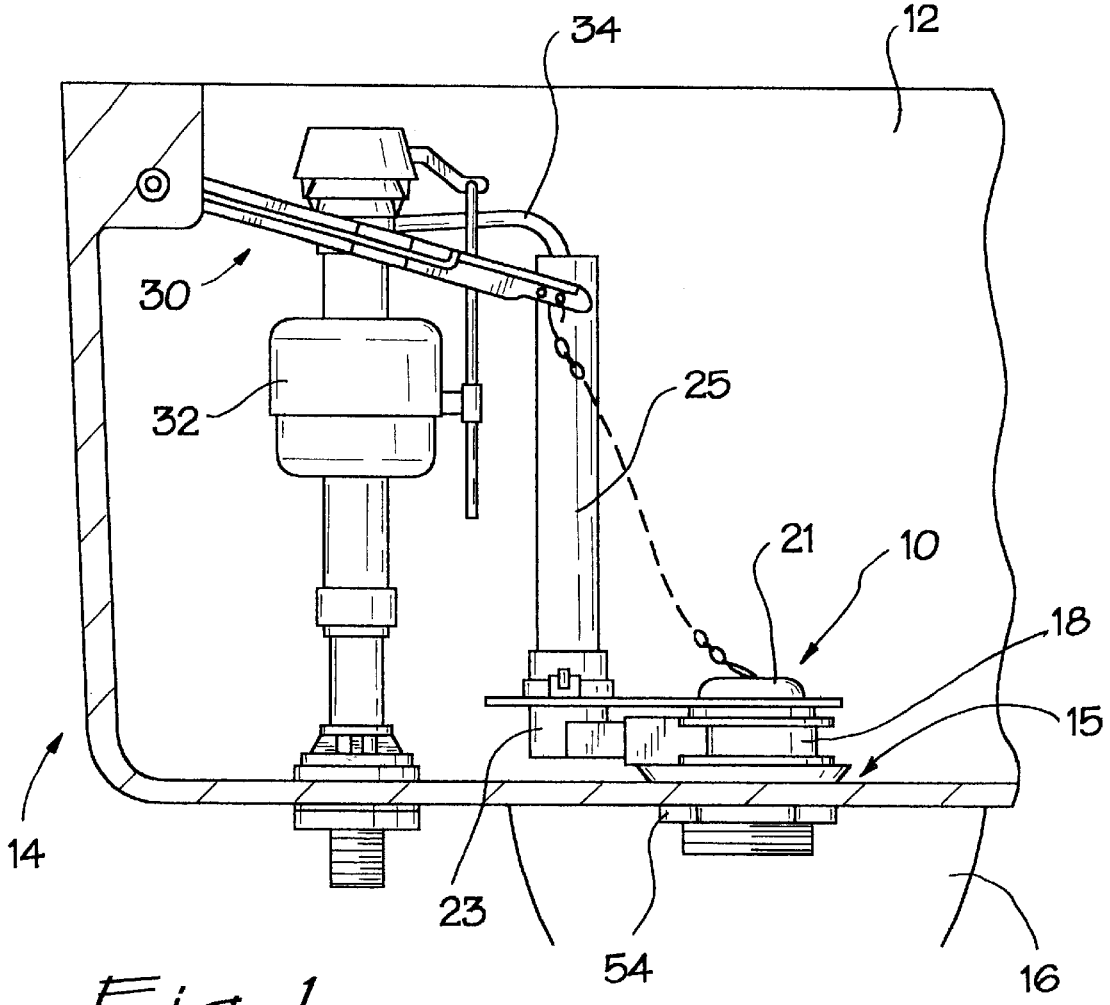
FIG. 1 is a side elevation partially in construction showing the interior of a toilet tank.

A flush valve is illustrated in the side elevation view of FIG. 1 and designated generally by the reference numeral 10. The flush 10 in this embodiment is mounted in a toilet 12 which includes a toilet tank 14 and a toilet bowl 16. In a typical manner, the flush valve 10 is mounted in a hole 15 and controls fluid flow between the tank 14 and bowl 16. As shown in FIG. 1, the flush valve 10 includes a valve seat 18, a flapper 21, a valve elbow 23, and an overflow tube 25.

In addition to the flush valve 10, the toilet 14 includes a fill valve 30 which is mounted within the tank 14 and includes a float 32 and bowl fill tube 32. In operation, the fill valve 30 receives water from outside the toilet 12 and fills the tank 14 to a predetermined level controlled by the float 32. As water is received within the tank 14 through the fill valve 30, a portion of the water is introduced through the bowl fill tube 32 into the overflow tube 25 to partially fill the bowl 16. The toilet 12 can be flushed by operation of an exterior button or handle which functions to lift the flapper 21 from the valve seat 18 and empty the water within the tank 14 into the bowl 16. After completion of the flush, the flapper 21 seals the seat 18 to permit filling of the tank 14 by the valve 30.

Figure 2:
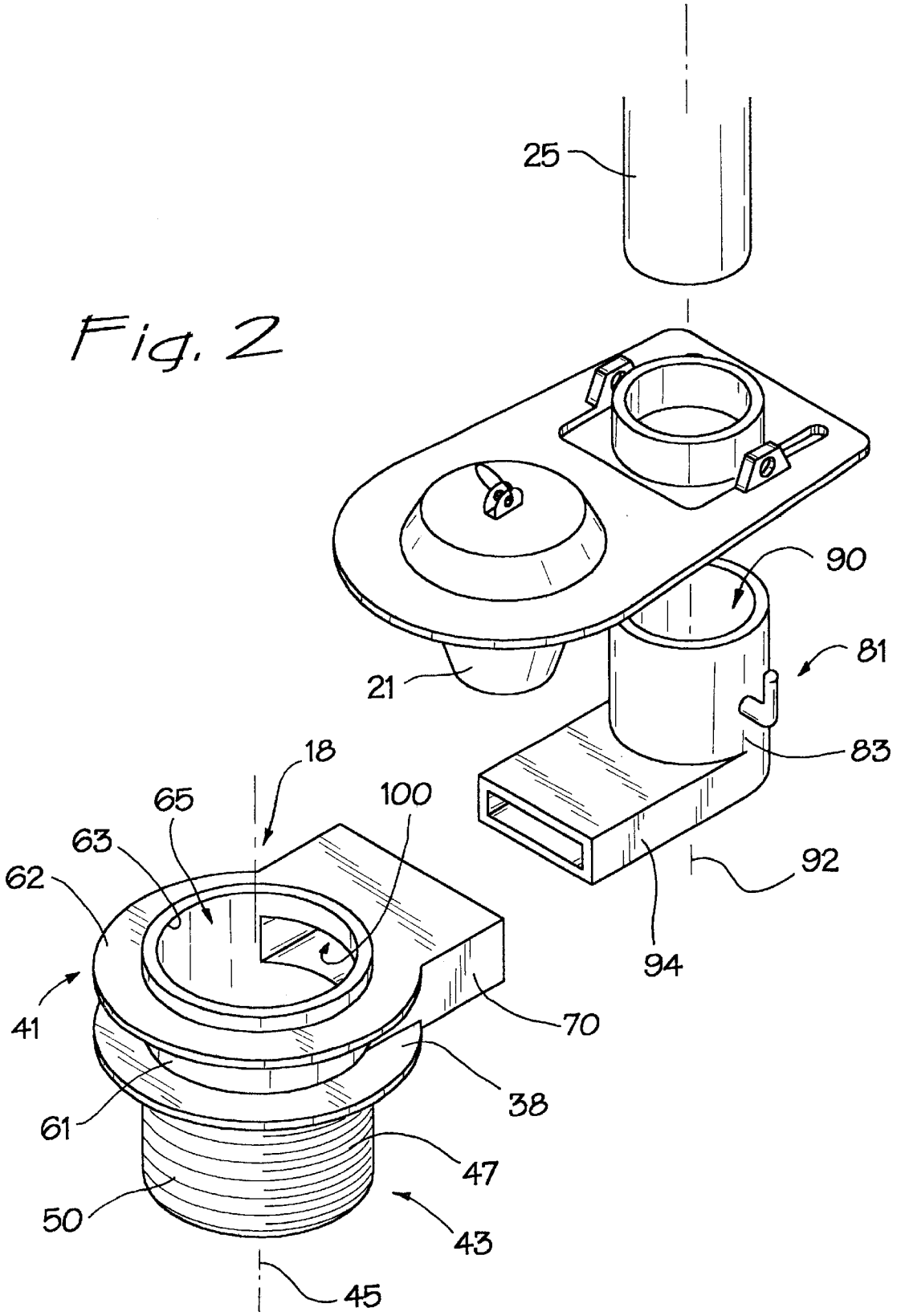
FIG. 2 is an exploded perspective view of a valve seat, valve opening flush tube and flapper associate with the flush valve of the present invention.

The flush valve 10 of the present invention is illustrated in the exploded view of FIG. 2. In this view it can be seen that the valve seat 18 can be formed with an annular flange 38 which divides the seat 18 between an upper section 41 and a lower section 43.

The lower section 43 which extends along a valve seat axis 45, is preferably formed with the configuration of a cylinder 50 having exterior threads 52. When operably mounted, the cylinder 47 is inserted into the hole 15 extending between the tank 14 and the bowl 16, where the exterior threads 52 are engaged by a nut 54 to form a seal between the bottom of the tank 14 and the annular flange 38.

The top section 41 includes a sidewall 61 which has a frusto-conical configuration. This sidewall 61 defines a central channel 63 which extends from the cylinder 47 in the lower section 43, upwardly to portions 64 which define an enlarged hole or opening 63 at the top of the valve seat 18. These portions 64 of the sidewall 61 define the opening 63 in an orientation that is of particular significance to the present invention. Since these portions 65 form a seat for the flapper 21, uniform loading of the flapper 21 is achieved when the opening 63 is defined in a horizontal plane which is generally perpendicular to the axis 45.

Figure 3:
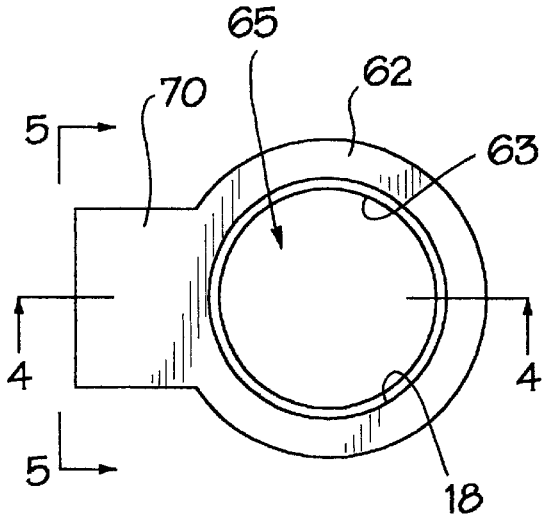
FIG. 3 is a top plan view of the valve seat illustrated in FIG. 2.

In this embodiment, the cylinder 47, flange 38, sidewall 61, opening 63 and flapper 21 all have a circular configuration in radial cross-section. This configuration is best illustrated in the plan view of FIG. 3.

Figure 4:
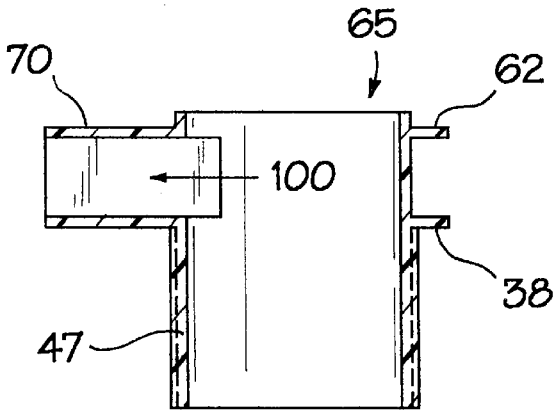
FIG. 4 is a radial cross section view with technical long lines 4—4 of FIG. 3.
Figure 5:
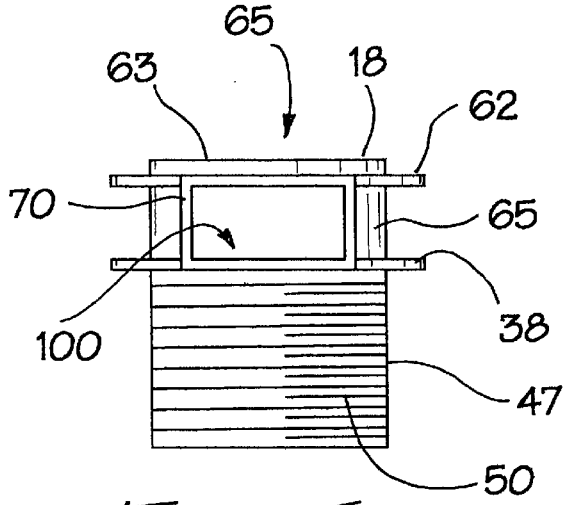
FIG. 5 is a side elevation view with technical long lines 5—5 of FIG. 3.

The valve seat 18 also includes a sleeve 70 which extends laterally of the sidewall 61 in communication with the central channel 63. This sleeve 70 preferably has a non-circular configuration, which is rectangular in the preferred embodiment. This rectangular configuration is best illustrated in the cross section view of FIG. 4 and the side view of FIG. 5.

Figure 6:
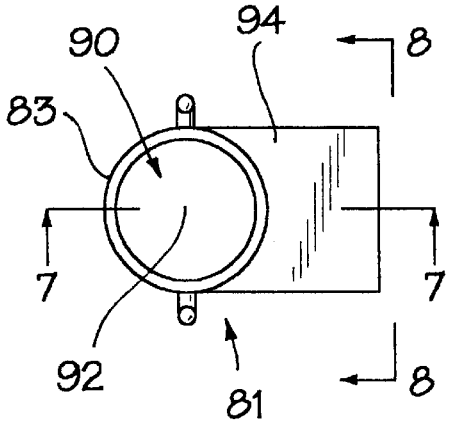
FIG. 6 is a top plan view of the valve elbow illustrated of FIG. 2.
Figure 7:
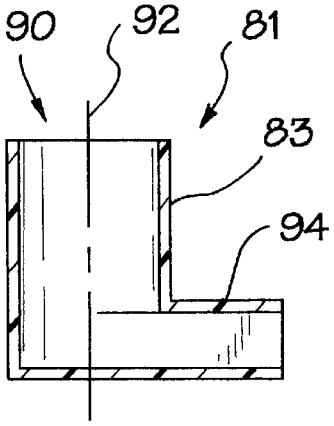
FIG. 7 is a radial cross section view with technical long lines 7—7 of FIG. 6.
Figure 8:
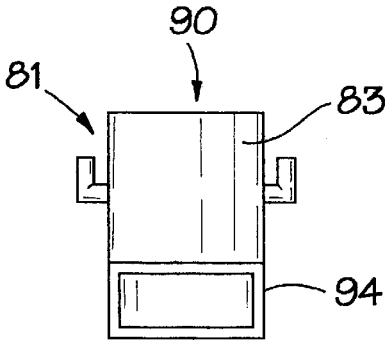
FIG. 8 is a side elevation view with long lines 8—8 of FIG. 6.

FIG. 2 also illustrates an elbow 81 which forms a portion of the flush valve 10. This elbow 81 includes a cylinder 83 which is sized and configured to receive the overflow tube 25. The cylinder 83 can be provided with exterior support arms 85 and 87 which extend laterally in opposite directions to pivotally support the flapper 21. The cylinder 83 defines an overflow channel 90 which extends generally along an axis 92 of the elbow 81. A second sleeve 94 extends laterally of the cylinder 83 in fluid communication with the overflow channel 90. The overflow channel 90 is best illustrated in the plan view of FIG. 6. The preferred rectangular cross-sectional configuration of the second sleeve 94 is best illustrated in the cross-sectional view of FIG. 7 and the side view of FIG. 8.

One of the final steps in the construction of the flush valve 10 is the telescopic engagement of the first sleeve 70 of the valve seat 18 and the second sleeve 94 of the valve elbow 81. With the sleeves 70 and 94 provided with similar cross-sectional configurations, the second sleeve 94 can be inserted into the first sleeve 70 to define a lateral passage 100 which extends in fluid communication with the overflow channel 90 of the elbow 81 and the central channel 63 of the valve seat 18. With an appropriate control of tolerances, the second sleeve 94 can be forced into the first sleeve 70 to provide a fictional fit and a generally sealed relationship.

Figure 9:
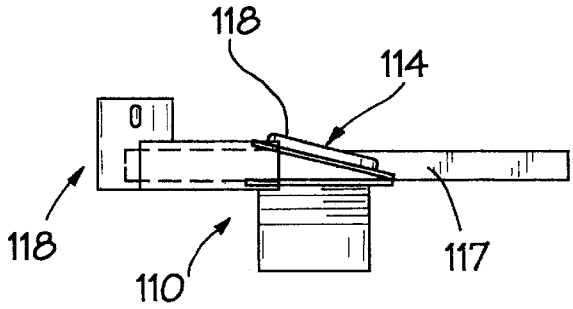
Fig. 9 PRIOR ART
FIG. 9 is a side elevation view of a further embodiment of the invention.

A method of manufacturing a flush valve 110 of the prior art is illustrated in FIG. 9. This valve 110 was injection molded using a core pin 112 to define a passage 114 in a valve seat 116. In order to define the passage 114 horizontal and generally perpendicular to the axis of the seat 116 and elbow 118, it was necessary to cant or incline the opening into the seat 116. Unfortunately this provided non-uniform loading of the flapper seat and also limited the cross-sectional area of the passage 114.

Figure 10:
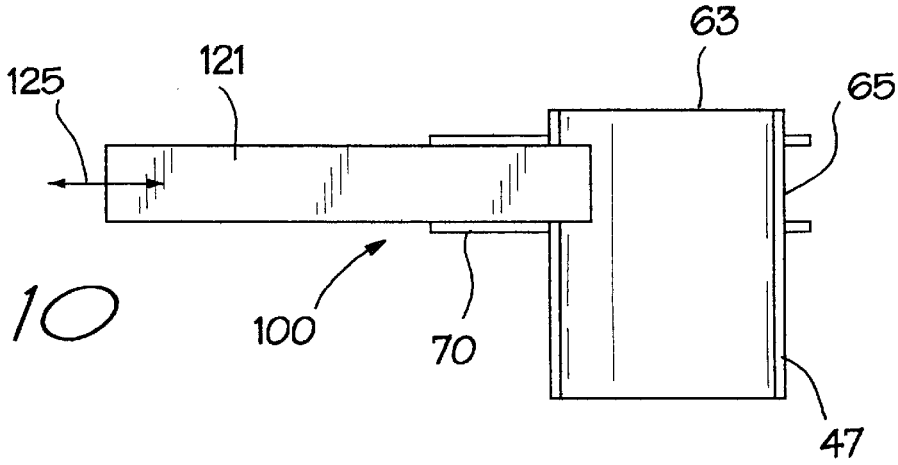
FIG. 10 is a radial cross section view showing the core pin used to define the first sleeve.

A method of the present invention is illustrated in FIG. 10 where a core pin 121 is used to define the first sleeve 70. Since the flush valve 10 is not required to be injection molded as a single piece, the core pin 121, which is used to define the sleeve 70, need not be inserted through the opening 64 defined by the sidewall portions 65. Rather, the pin 121 can be inserted and removed laterally as shown by the arrow 123. As a result, the passage 100 is not limited by the size of the opening 64. Nor is the orientation of the opening 64 required to be canted as was the case with the injection molded devices of the prior art.

Figure 11:
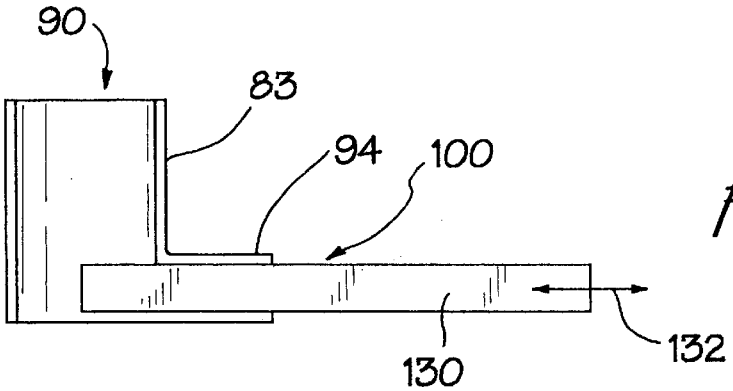
FIG. 11 is a radial cross section view showing the core pin define the second sleeve.

This same advantage can be achieved in injection molding the valve elbow 81 as illustrated in FIG. 11. In this case, a core pin 130 can be used to mold the second sleeve 94. This pin 130 can also be inserted and removed laterally as shown by the arrow 132. Once again, the lateral passage 100 can be formed without any concern for the size of the opening 63 or the canting of its plane of orientation.

In the final assembly step, the second sleeve 94 can be inserted into the first sleeve 70 to form the flush valve 10. While maintaining the advantages of injection molding, the resulting valve 10 has uniform sealing pressure with the plane of the opening 64 generally horizontal and perpendicular to the axis 45. The lateral passage 100 can be maximized without any limitations based on the size of the opening 63. The size of the lateral passage 100 can be maximized without any limitations based on the size of the opening 63. This facilitates the larger overflow volume which is of significant advantage to the flush valve 10.

It will be apparent that many of the advantages of this construction can be achieved in other embodiments of the flush valve 10. For example, as illustrated in FIG. 9, a one-piece injection molded construction can be achieved with the opening 63 defined generally perpendicular to the axis 45. In constructing this embodiment, a core pin 140 can be inserted and removed through the opening 63 as taught by the prior art. However, in this case, the core pin 140 defines the lateral channel 100 at an angle other than 90 degrees to the axis 45. Accordingly, the lateral channel is canted so that the opening 64 can be maintained in the horizontal orientation to achieve uniform loading of the flush valve 10.

These and other modifications to the disclosed embodiments will be apparent to those skilled in the art. As a result, one is cautioned not to determine the extent of this concept only with reference to the disclosed embodiments, but rather encouraged to determine the scope of the invention only with reference to the following claims.

What is claimed is:

1. A method for manufacturing a flush valve, comprising the steps of:

injection molding a valve seat having a sidewall defining a central channel extending along a first axis and an opening facing along the first axis;

during the first molding step inserting a first core pin to define a first sleeve extending generally perpendicular to the axis of the valve seat;

injection molding a valve elbow with an overflow section extending along a second axis;

during the second molding step inserting a second core pin to define a second sleeve extending generally perpendicular to the second axis of the valve elbow; and inserting the second sleeve of the valve elbow into the first sleeve of the valve seat to provide fluid communication between the overflow section of the valve elbow and the central channel of the valve seat.

2. The method recited in claim 1 wherein the first molding step includes the step of removing the first core pin in a direction generally perpendicular to the first axis of the valve seat.

3. The method recited in claim 2 wherein the second molding step includes the step of removing the second core pin in a direction generally perpendicular to the second axis of the valve elbow.

4. The method recited in claim 1 wherein the first molding step includes the step of forming the opening of the valve seat in a plane generally perpendicular to the axis of the valve seat.

5. The method recited in claim 1 wherein the inserting step includes the step of forcing the second sleeve into the first sleeve to establish a friction fit sufficient to maintain the valve seat and the valve elbow in a fluid communication relationship.

* * * * *